United States Patent [19]

Fournier et al.

[11] Patent Number: 4,982,769

[45] Date of Patent: Jan. 8, 1991

[54] PACKAGE

[75] Inventors: Donald J. Fournier, Cleveland, Ohio; Douglas W. Jacobs-Perkins, Kensington,, Md.

[73] Assignee: Survival Technology, Inc., Bethesda, Md.

[21] Appl. No.: 482,874

[22] Filed: Feb. 21, 1990

[51] Int. Cl.[5] ..... B65D 83/10; B65D 81/32

[52] U.S. Cl. ..... 141/98; 141/27; 141/97; 141/329; 141/312; 141/319; 206/222; 206/364; 215/11.006; 215/DIG. 3; 215/227; 604/905; 604/415; 604/403; 604/416; 604/88; 604/90

[58] Field of Search ..... 141/98, 329, 320, 25–27, 141/18, 97, 286, 312, 319–322; 206/219, 222, 221, 364, 365; 215/11.6, DIG. 3, DIG. 8, 227; 604/403, 411, 415, 416, 905, 87, 86, 89, 90

[56] References Cited

U.S. PATENT DOCUMENTS

| | | | |
|---|---|---|---|
| 2,953,170 | 9/1960 | Bush | 141/18 |
| 3,373,864 | 3/1968 | Barton et al. . | |
| 4,089,432 | 5/1978 | Crankshaw et al. | 215/DIG. 3 |
| 4,124,953 | 11/1978 | Patton . | |
| 4,457,749 | 7/1984 | Bellotti et al. | 604/905 X |
| 4,746,017 | 5/1988 | Howard et al. | 215/DIG. 3 |
| 4,768,568 | 9/1988 | Fournier et al. | 141/286 |
| 4,878,903 | 11/1989 | Mueller | 206/364 X |

*Primary Examiner*—Ernest G. Cusick

*Attorney, Agent, or Firm*—Cushman, Darby & Cushman

[57] ABSTRACT

A package comprising a package container structure having an open end leading into an interior chamber therein, a package lid structure mounted over the open end of the package container structure in generally sealed relation with the interior chamber thereof so as to be moved into opening relation thereto, and a device for use with a medicament vial disposed within the sealed interior chamber. The device and package container structure have interengageable elements disposed out of interengagement when the device is disposed within the sealed interior chamber operable when the package lid structure is moved into opening relation and the device is moved out of the open end of the interior chamber to be moved into interengagement. The device and package container structure with the interengaging elements thereof interengaged provide a generally sealed interior space including the interior chamber within which a medicament vial is contained in cooperating relation with the device.

19 Claims, 2 Drawing Sheets

PACKAGE

BACKGROUND OF THE INVENTION

This invention relates to packaging and more particularly to packaging of devices useful with medicament vials or the like.

A specific preferred example of a device of the type herein contemplated is disclosed in commonly assigned U.S. Pat. No. 4,768,568. This patent discloses a device in the form of a control assembly for use with a vial having a hazardous material therein and an open end sealingly closed by an elastomeric stopper assembly. The purpose of the control assembly is to enable a user to mix a diluent with the hazardous material within the vial and then fill a syringe having a hypodermic needle with the liquid solution in such a way as to substantially prevent the hazardous material from entering the immediate atmospheric environment. In the opening paragraphs of the specification of the aforesaid patent, there is discussion and identification of a number of devices of this type. The present invention contemplates packaging of any of the prior art devices of this type. However, a preferred device is the control assembly disclosed in the aforesaid patent.

The control assembly disclosed in the patent includes a hollow control structure having opposite first and second open ends. The first open end of the control structure is closed by a septum capable of having the syringe needle moved in penetrating relation therethrough and of providing a seal after the syringe needle has been withdrawn. The control structure is capable of being fixedly secured to the vial so that the second open end thereof is disposed in sealed relation to the stopper assembly end of the vial. A piston is mounted within the hollow interior of the control structure between the open ends dividing the hollow interior into a vented chamber communicating with the septum through the first open end and a sealed chamber communicating with the central exterior of the elastomeric stopper assembly of the vial through the second open end. The vented chamber is vented to the atmosphere and a filter is disposed in the vent so as to permit the vented chamber to remain at atmospheric conditions while preventing movement of hazardous material outwardly through the vent past the filter. The piston is mounted within the control structure for movement from an initial position wherein the volume of the vented chamber is maximum and the volume of the sealed chamber is minimum to a final position wherein the volume of the vented chamber is minimum and the volume of the sealed chamber is maximum. The central portion of the piston is formed of a resilient material in a size and shape sufficient to provide the capability of having the syringe needle which is first moved in penetrating relation through the septum thereafter moved in penetrating relation through the central portion of the piston and of providing a seal after the syringe needle has been withdrawn so that when the syringe needle after having been moved in penetrating relation successively through the septum and the piston is thereafter moved in penetrating relation through the elastomeric stopper of the vial, any elevated pressure conditions and aerosoling of hazardous material which passes outwardly of the elastomeric stopper incident to syringe needle withdrawal therefrom is captured within the sealed chamber and any elevated pressure conditions produced thereby are reduced substantially to atmospheric conditions by the increase of the volume of the seal chamber through movement of the piston from its initial position until the pressure causes the piston to reach its final position so that the subsequent withdrawal of the syringe needle from the piston occurs while the sealed chamber is generally under atmospheric conditions and, hence, no aerosoling of hazardous material into the vented chamber occurs incident to such withdrawal, thereby enabling the subsequent withdrawal of the syringe needle from the septum to occur under uncontaminated atmospheric pressure conditions within the vented chamber.

As disclosed in the patent, the device is particularly suited for use in situations where the diluent filling and mixing procedures are performed separately from the procedures relating to the filling of a syringe with the liquid solution. Typically, these functions are separately defined in a hospital situation where the dry medicament within the vial is, subsequently, mixed with diluent in the pharmacy and a different syringe is filled with the liquid solution prior to administration either in the ward or in the patient's room. Under these circumstances, while in the pharmacy it is desirable to equalize the pressure within the vial after the diluent has been inserted and mixed with the dry or freeze dried medicament. This pressure equalization is achieved simply by releasing the diluent syringe plunger with the end of the needle communicating within the upper portion of the interior of the vial confining the gaseous fluid therein above the liquid solution. The plunger will be displaced by the pressure. This will reduce the pressure within the vial substantially to atmospheric conditions. The needle of the syringe with the gaseous fluid filled therein is then withdrawn from the stopper assembly and piston so that the end of the needle is disposed within the vented chamber. The gaseous fluid contents of the diluent syringe chamber are then extruded through the needle into the vented chamber and finally the needle is withdrawn with the syringe chamber exhausted. Similarly, when the filling procedures are to be undertaken, it is preferable to first withdraw the plunger of the syringe and to expel the gaseous contents of the syringe chamber into the vial after the needle has been moved through the stopper assembly. This introduction of pressure into the vial chamber is then used to assist in moving the liquid solution back into the chamber of the syringe. This is accomplished by inverting the vial so that the open end of the needle penetrates just through the stopper assembly and the gaseous pressure on top of the liquid serves to move the same downwardly through the needle and into the syringe.

The device of the patent is thus effective in alleviating the possibility of hazardous material from entering the immediate environment. However, the device does not provide any protection against contamination of the environment in the event that the vial container itself should be accidentally fractured so as to spill the contents to the environment.

SUMMARY OF THE INVENTION

An object of the present invention is to provide packaging for the device which once opened is capable of cooperating with the device to provide a measure of protection against vial container fracture. In accordance with the principles of the present invention, this objective is obtained by providing a package comprising a package container structure having an open end leading into an interior chamber therein, a package lid structure mounted over the open end of the package container structure in generally sealed relation with the interior chamber thereof so as to be moved into opening relation thereto, and a device for use with a medicament vial disposed within the sealed interior chamber. The device and package container structure have interengageable elements disposed out of interengagement when the device is disposed within the sealed interior chamber operable when the package lid structure is moved into opening relation and the device is moved out of the open end of the interior chamber to be moved into interengagement. The device and package container structure with the interengaging elements thereof interengaged provide a generally sealed interior space including the interior chamber within which a medicament vial is contained in cooperating relation with the device.

As previously indicated, preferably the device is a control assembly for enabling the medicament in the vial, in the form of a dry hazardous material, to be properly diluted and filled in a syringe in such a way as to substantially prevent the hazardous material from entering the immediate environment. Alternatively, the device may be for simply filling a syringe with a liquid medicament in such a way as to substantially prevent the liquid medicament or its vapor from entering the immediate environment. Commensurately, it is preferable to provide interengaging elements which function to retain the device and package container structure in space providing relation such that disengagement of the interengaging elements is significantly more difficult to manually accomplish than interengagement so as to encourage disposal of the used vial while retained in the sealed interior space provided by the device and the package container structure. In this way, the hazardous material retained in the device as a result of the use thereof will not be exposed to the environment as a result of interengaging element disengagement and disassembly of the device and package container structure from each other and the used vial.

Another object of the present invention is the provision of a package of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

IN THE DRAWINGS

DESCRIPTION OF THE INVENTION

Figure 1:
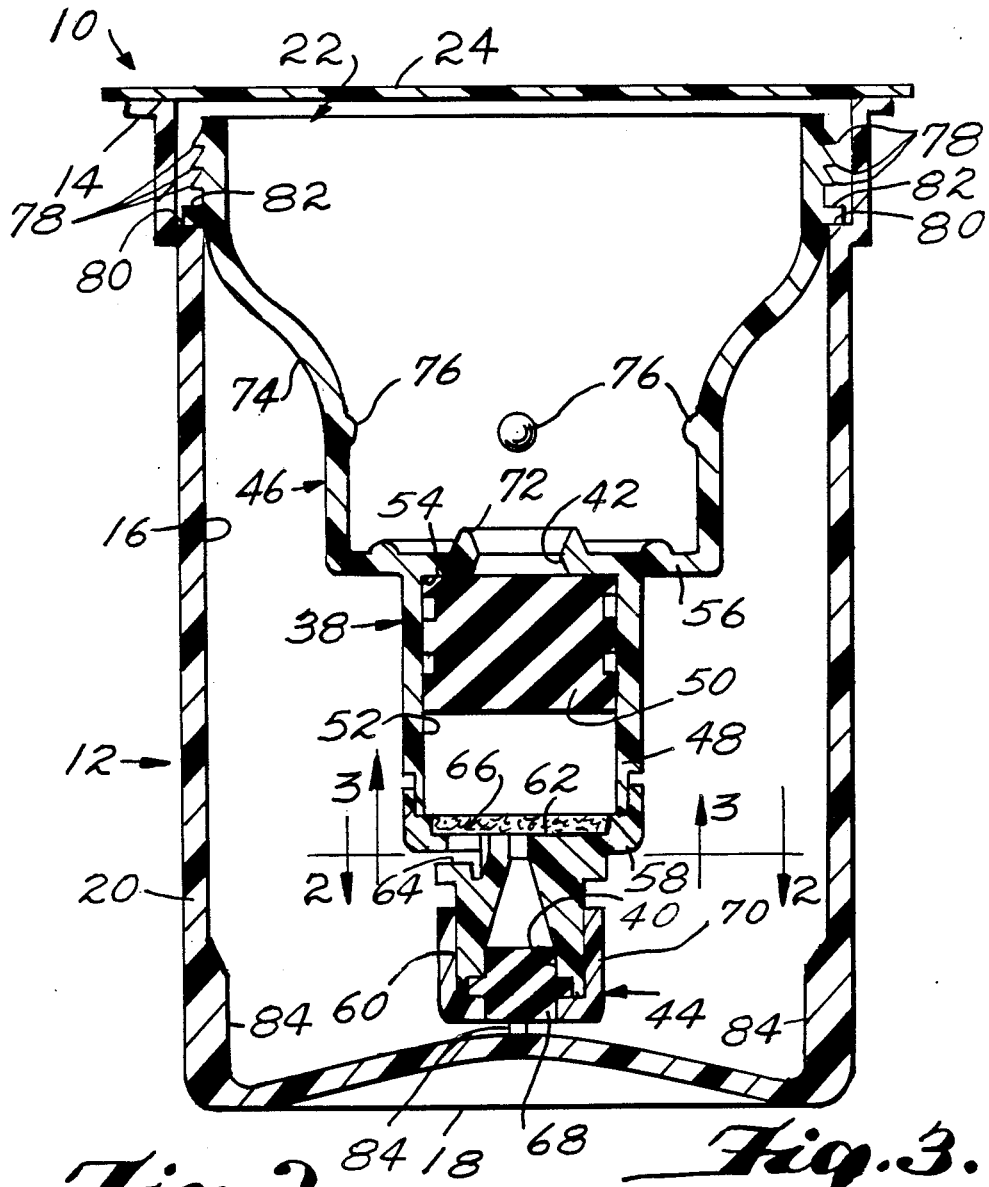
FIG. 1 is a longitudinal sectional view of a package embodying the principles of the present invention.
Figure 2:
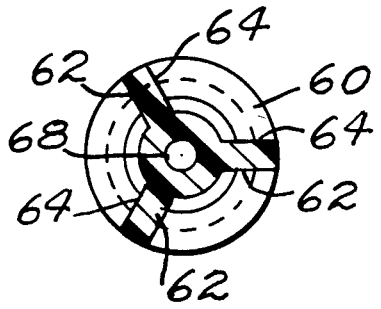
FIG. 2 is an enlarged fragmentary sectional view taken along the line 2—2 of FIG. 1.
Figure 3:
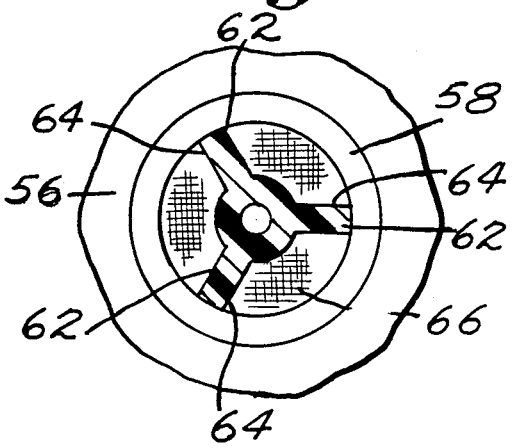
FIG. 3 is an enlarged fragmentary sectional view taken along the line 3—3 of FIG. 1.

Referring now more particularly to the drawings, there is shown in FIG. 1 thereof a package, generally indicated at 10, embodying the principles of the present invention. The package 10 comprises a package container structure, generally indicated at 12, having a flanged open end 14 leading into an interior chamber 16 defined by a circular bottom wall 18, which, as shown, is concavo-convex, and a cylindrical peripheral wall 20. Mounted within the interior chamber 16 is a device, generally indicated at 22, for use with a medicament vial. A package lid structure 24 is mounted over the open end of the package container structure 12 in generally sealed relation with the interior chamber 16 thereof. The package lid structure 24 is mounted for movement into opening relation with the interior chamber 16.

Preferably, the package lid structure 24 is a shaped flat sheet of semi-permeable membrane type material capable of enabling the device 22 to be sterilized, as by gamma rays, ethylene oxide and other known methods, after the package 10 is assembled. A preferred semi-permeable material is made by DuPont under the registered trademark TYVEK®. The mounting of the package lid structure 24 may be by any suitable means; however, a preferred sealing arrangement is by heat sealing. Heat sealing is particularly preferred where the package container structure 12 is formed of a thermoplastic material which also permits sterilization as aforesaid or after the completion of the package 10. An exemplary thermoplastic material for the package container structure 12 is TPX manufactured by Mitsui Petrochemical. Preferably, the plastic is clear so as to enable the vial to be readily viewed therethrough when in cooperating relation therewith. The heat sealing of the package lid structure 24 on the package container flanged open end 14 renders the package lid structure 24 easily removable to open the interior chamber 16.

Figure 4:
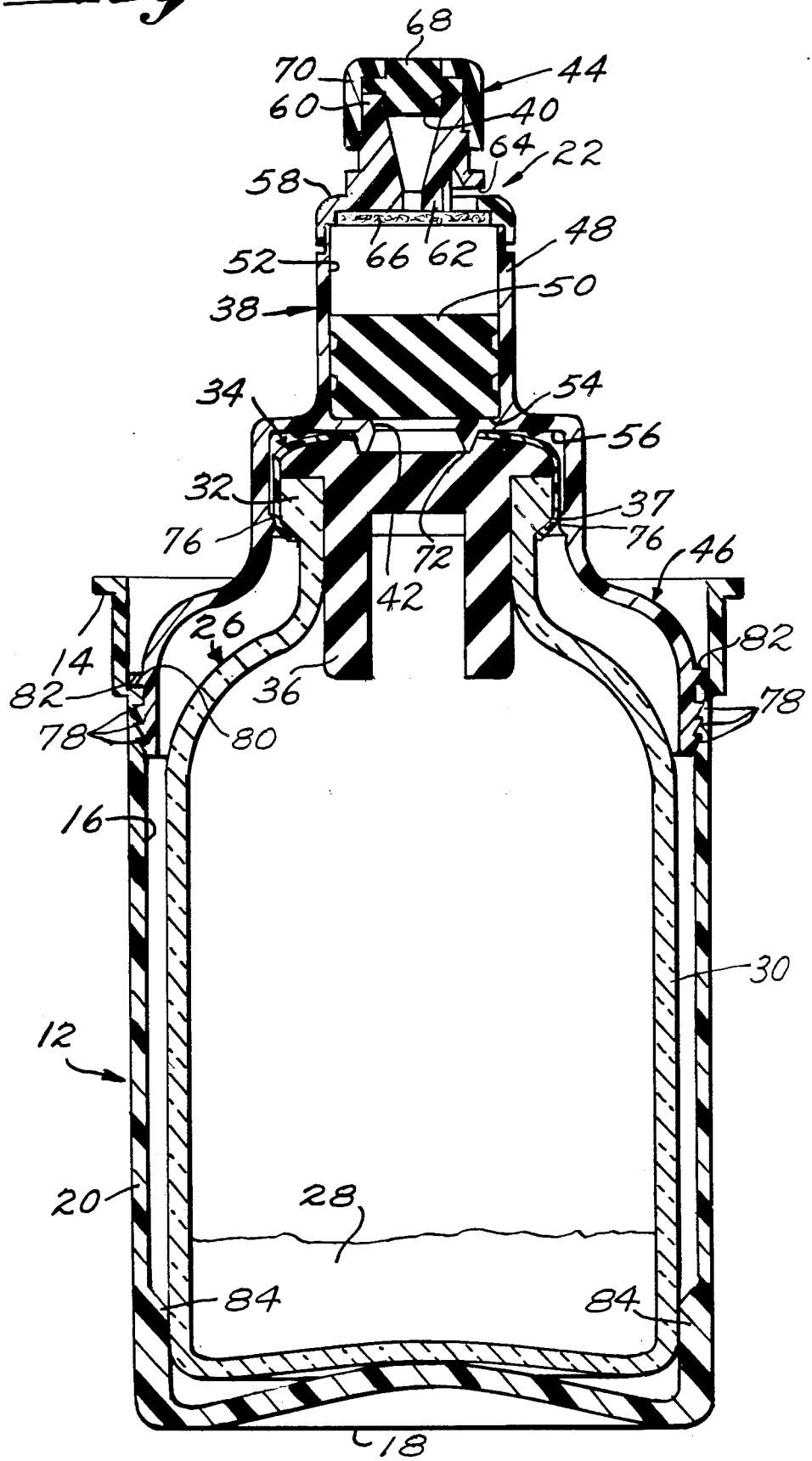
FIG. 4 is a longitudinal sectional view showing the components of the package operatively associated with a medicament vial in accordance with the principles of the present invention.

While the device 22 may be any known device for use with a medicament vial, preferably the device 22 is constructed in accordance with the disclosure set forth in U.S. Pat. No. 4,768,568, which disclosure is hereby incorporated by reference into the present specification. As shown in FIG. 1, the device 22 is in the form of a control assembly which is cooperable with a medicament vial, shown in FIG. 4 and designated generally by the reference numeral 26, for enabling a user to mix a diluent with the vial medicament which is a hazardous material 28 and then fill a syringe with the resultant medicament solution in such a way as to substantially prevent hazardous material from entering the immediate atmospheric environment. The medicament vial 26 is of conventional construction and includes a glass container 30 having an exteriorly beaded necked in open end 32 which is sealed by an elastomeric stopper assembly, generally indicated at 34, of conventional configuration. The stopper assembly 34 includes the usual elastomeric stopper 36 mounted within the open end 32 of the vial container 30 and held therein by an annular cap member 37. Annular cap member 37 is merely illustrative and need not be provided unless specifically desired. The medicament sealed within the vial container 30 by the stopper assembly 34 is preferably hazardous material 28 in the form of a dry cytotoxic drug (anti-neoplastic drug) of the type frequently used in treating cancer. Within the vial container 30, the cytotoxic drug is preferably in freeze dried or powder form suitable to be readily dissolved or diluted by a diluent to form an injectable liquid solution containing the hazardous material 28.

The control assembly device 22 includes a hollow control structure, generally indicated at 38, providing opposite open ends 40 and 42. The open end 40 is closed by a septum assembly, generally indicated at 44, and an attaching assembly, generally indicated at 46, is carried by the hollow structure 38 for mounting it on the stoppered end of the vial so that the open end 42 is disposed in sealed communicating relation with the exterior of the central portion of the elastomeric stopper 36.

The hollow structure 38, as shown, is made up essentially of two plastic moldings. The first of these provides a cylindrical wall 48 having an inner cylindrical surface defining the major periphery of a control chamber space between the open ends 40 and 42. In accordance with the principles of the present invention, a movable pressure containing means in the form of a piston 50, preferably made of elastomeric material, is slidably mounted with its exterior periphery in engagement with the cylindrical surface for movement from an initial limiting position, shown in FIG. 1, to a final limiting position. The piston 50 divides the control chamber space defined by the cylindrical surface into two variable volume control chambers 52 and 54. The control chamber 54 is a sealed control chamber which communicates with the open end 42 and is positioned between the medicament chamber 28 and the control chamber 52, which is a vented control chamber.

In its initial limiting position, the piston 50 engages a radially extending annular wall 56 which is integral with the adjacent end of the cylindrical wall 48 and extends both radially inwardly and radially outwardly therefrom. The radially inwardly extending portion of the annular wall 56 provides an upwardly facing surface which engages the piston when in its initial limiting position. The final limiting position is determined by engagement of the piston 50 with an inwardly extending annular section of a first tubular portion 58 of the second plastic molding, the remaining section of which constitutes a cylindrical skirt section which is suitably rigidly secured in surrounding abutting relation with the adjacent end portion of the cylindrical wall 48. The second plastic molding includes a second tubular portion 60 which is connected with the first tubular portion 58 by a plurality of radially extending ribs 62 which define therebetween vent openings 64. The inwardly facing surface of the second tubular portion 60 is formed with a small annular ridge (not shown) constituting an energy director and a second inwardly facing surface of the first tubular portion 58 is formed with a second energy director. The energy directors are utilized to sealingly connect, as by ultrasonic energy, a centrally apertured thin cylindrical filter pad 66 of plastic material in fibrous form so that the filter pad extends over the vent openings 64 and serves to prevent passage of hazardous material 24 outwardly of the vented control chamber 52. The filter pad is preferably hydrophobic and has a pore size of approximately 0.2 microns.

The septum assembly 44 is preferably in the form of a centrally enlarged septum disk 68 engaged upon an annular sealing ridge formed on the upper end of the second tubular portion 60 and retained in sealingly engaged relation therewith by a centrally apertured cap 70 suitably fixed to the second tubular portion 60.

The lower portion of the sealed control chamber 54 communicates with the exterior surface of the central portion of the elastomeric stopper 36 in sealing relation To this end, a depending annular lip 72 is formed on the inner portion of the radial wall 56 so as to engage with the exterior surface of the elastomeric stopper 36.

The attaching structure 46 includes an annular stepped skirt 74 which is integral with and extends downwardly from the outer periphery of the radial wall 56. The stepped skirt 74 includes an upper smaller diameter portion of a size to fit over the vial stopper assembly 34 which is formed with a series of annularly spaced bumps 76 for engaging beneath the vial stopper assembly 34. As shown, there are four bumps 76 provided; although more may be utilized if desired. The lower portion of the skirt 74 is of larger size having an interior dimension slightly greater than the exterior dimension of the vial container 30. Formed on the lower exterior periphery of the skirt 74 is one of two interengageable elements the other of which is on the package container structure 12. These interengaging elements may be threads but preferably are constructed so that disengagement is significantly more difficult to manually accomplish than interengagement. In a preferred embodiment, at least one of the interengaging elements is of saw tooth configuration in section in which the slanted surface extends in the direction of engagement and the perpendicular surface faces in the direction of disengagement. While the invention contemplates two cooperating rings, each of saw tooth configuration, which snap together, the embodiment shown is one in which a plurality of axially spaced rings 78 of saw tooth configuration in cross-section are formed on the interior surface of the skirt 74 adjacent its free end.

As best shown in FIG. 1, the package container structure 12 is formed with a larger diameter adjacent the flange 14 for an extent sufficient to house the rings 78 and so as to provide an outwardly facing shoulder 80. The peripheral wall 20 provides an interior cylindrical surface extending inwardly of the shoulder 80 which is of a diameter slightly less than the maximum diameter of the rings 78.

With this arrangement, the rings 78 interengage with the cylindrical surface of the wall 20 when the skirt 74 is pushed with a rectilinear movement into the container structure 12 by the sharp edges of the rings 78 digging into the cylindrical interior surface of the container wall 20. It is within the contemplation of the invention to rely upon the seal provided by the interengagement of the interengaging elements In the drawings, there is shown a flange 82 on the exterior of the skirt 74 in inwardly spaced relation to the rings 78 for engaging the shoulder 80 when in vial enclosing cooperating relation with the package container structure 12 and for supporting the device from the shoulder 80 when in packaging relation within the chamber 16 of the package container structure 12. While the flange 82 is not required, it exemplifies a possible alternative or adjunctive means of effecting a seal by virtue of its engagement with the shoulder 80.

Preferably, the interior dimension of the cylindrical interior surface of the peripheral wall 20 is greater than the exterior dimension of the vial container 30. However, in order to be able to center the vial container 30 within the container structure 12 and to retain such centered relationship, a series of annularly spaced ribs 84 are formed integrally on the peripheral wall 20 of the package container structure 12 adjacent the bottom wall 18. Preferably, bottom 18 is of concavo-convex configuration bulging inwardly so that the central portion engages the central bottom of the vial container 30 which itself is usually of concavo-convex configuration and bulges inwardly.

A typical operation of the package 10 would occur in the pharmacy of a hospital by the attendant who is charged with the responsibility of diluting the freeze dried hazardous material 28 within the medicament vial 26 with a suitable diluent and of mixing the same to form a liquid mixture which is to be transported to the ward or patient's room for injection by the attendant therein. The operation of the package 10 by the attendant is first to remove the package lid structure 24 from the package container structure 12 by simply stripping off the package lid structure 24 from the flanged open end 14 of the container structure 12.

Next, the vial 26 is inverted so that the open end 32 and elastomeric stopper assembly 34 thereof extend downwardly. In this inverted position, the vial 26 is lowered into the open upper end of the package container structure 12 until the cap member of the elastomeric stopper 34 snaps past the interior bumps 76 in the upwardly opening skirt 74. The bumps 76 serve to retain the device 22 on the vial 26 in cooperating relation therewith wherein the edge 72 engages the exposed central upper surface of the elastomeric stopper 36. This retention enables the operator to lift the device 22 upwardly out of the package container structure 12 by simply lifting the vial 26 while holding the package container structure 12, if desired. In this way, the device 22 can be mounted in operative relation with the vial 26 without the necessity of actually touching the device 22 at a time immediately after the sterile device 22 has been exposed to the atmosphere by the removal of the package lid structure.

Next, the vial 26 with the device 22 retained thereon is again inverted from its raised inverted position so that the bottom wall of the vial container 30 faces downward. The vial container 30 is then lowered into the chamber 16 until ribs 84 engage the vial container to center the vial and rings 78 and flange 82 pass within the enlarged open upper end portion of the wall 20. As soon as the lowermost ring 78 moves past the shoulder 80, the corner of which is chamfered, it is necessary for the operator to push down on the skirt 74 so as to interengage the interengaging elements by moving all of the rings 78 into the adjacent cylindrical surface of the wall 20. This pushing action is continued until the sealing lip 72 engages the stopper 36. Preferably, before the sealing lip 72 engages the stopper 36, the bottom wall 18 will engage the bottom wall of the vial container 30 so that the vial container is retained against free movement in any direction within the interior space provided by the sealed device 22 and package container structure 12 including the chamber 16 of the latter.

Alternatively, the bottom wall 18 may be made planar and a pad of readily compressible material (e.g. plastic foam) can be placed on the planar bottom wall for engagement by the bottom wall of the vial. The flexing of the concavo-convex bottom wall (or the pad) insures that there will be sufficient relative rectilinear movement available between the vial attached device 22 and the container structure 12 to insure that sealing lip 72 engages the stopper 36 at the end of the interengagement of the interengaging elements 78. Where the flange 82 is provided, it is made sufficiently flexible to deflect should it engage the shoulder 80 before the sealing lip 72 engages the stopper 36. Such movement may also be accommodated by constructing the ribs 84 to yieldingly grip the vial container 30 prior to the engagement of the bottom wall thereof with the bottom wall 18.

Once the medicament vial 26 is thus sealed, a measure of protection against breakage of the glass vial container 30 is provided by the surrounding container structure 12 and sealingly cooperating device 22. Moreover, the visually clear nature of the container structure 12 enables the user to see the vial container and its contents during the introduction of the diluent. It is sometimes desirable to visually observe that complete dilution has taken place within the vial container 30. Furthermore, after the device 22 itself has been used to effect dilution, a measure of protection is provided should vial container breakage or leakage occur by damage through the walls 18 and 20 of the container structure 12 while being transported from the pharmacy to the ward or patient's room or thereafter. In this way, the package 10 of the present invention serves to provide this measure of protection in addition to the environmental protection provided by the use of the device 22 itself in effecting the dilution of the hazardous material 28 and the subsequent filling of the diluted mixture into a patient's syringe. For details as to the operation of the device 22, reference can be had to the specification of U.S. Pat. No. 4,768,568.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

We claim:

1. A package comprising a package container structure having an open end leading into an interior chamber therein, a package lid structure mounted over the open end of said package container structure in generally sealed relation with the interior chamber thereof so as to be moved into opening relation thereto, and a device within said sealed interior chamber having means for cooperating with a medicament vial for use therewith, said device and said package container structure having interengageable means disposed out of operative interengagement when said device is disposed within said sealed interior chamber operable when said package lid structure is moved into opening relation and said device is moved out of the open end of said interior chamber to be moved into operative interengagement, said device and said package container structure with the interengageable means thereof operatively interengaged providing a generally sealed interior space including said interior chamber within which space the means of the device for cooperating with a medicament vial is operable to cooperate with a medicament vial contained within said space.

2. A package as defined in claim 1 wherein said device includes a control assembly for use with a medicament vial of the type including a glass vial container having an open end closed by an elastomeric stopper assembly so as to contain therein a medicament constituting a hazardous material, said control assembly including means enabling a user to fill a syringe having a hypodermic needle with a liquid containing the hazardous material in such a way as to substantially prevent the hazardous material from entering the immediate atmospheric environment, said interengageable means functioning to retain said device and said package container structure in space providing relation in a manner such that disengagement of said interengageable means is significantly more difficult to manually accomplish than interengagement so as to (1) encourage disposal of the used vial while retained in the sealed space provided by said device and said package container structure and (2) prevent hazardous material retained in the device by the use thereof from being exposed to the environment as a result of disengagement of said interengageable means and disassembly of said device and said package container structure from each other and said vial.

3. A package as defined in claim 2 wherein said device is disposed within said sealed interior chamber in a position suitable to enable the vial to be moved into cooperating relation with the means of the device for cooperating with the vial when said package lid structure is moved into opening relation to said package container structure so as to retain said device in cooperating relation with the vial to thereby enable the device to be moved out of the open end of said interior chamber and said interengageable means into engagement which said device is retained in operating relation with the vial.

4. A package as defined in claim 3 wherein said package container structure is a thin walled structure formed of a clear thermoplastic material suitable for radiation beam sterilization.

5. A package as defined in claim 4 wherein said package container structure includes a circular bottom wall and an annular peripheral wall extending from the periphery of the circular bottom wall and terminating in an outwardly extending annular flange defining the open end of said package container structure.

6. A package as defined in claim 5 wherein said interengageable means includes an annular shoulder formed in said annular peripheral wall in a position spaced from and facing toward said annular flange and an annular flange on said device for engaging said shoulder to support said device within said interior chamber.

7. A package as defined in claim 6 wherein said interengageable means further includes a generally cylindrical surface on the interior of said peripheral wall extending inwardly from said annular shoulder and a series of annular rings of saw tooth shaped cross-sectional configuration on said device, said series of rings having sharp edges for digging into said cylindrical surface in response to a relative rectilinear movement between said device and said package container structure.

8. A package as defined in claim 7 wherein said package lid structure comprises a sheet of material adhered to the annular flange of said package container structure, said sheet material being suitable to enable said device to be radiation beam sterilized while sealed in said interior chamber.

9. A package as defined in claim 8 wherein said sheet material is heat sealed with the annular flange of said package container structure.

10. A package as defined in claim 9 wherein said control structure includes a hollow control structure having opposite first and second open ends, the first open end of said control structure being closed by a septum capable of having the syringe needle moved in penetrating relation therethrough and of providing a seal after the syringe needle has been withdrawn, said control structure having a skirt portion for engaging over the open end and stopper assembly of the vial, said skirt portion having thereon (1) the means of the device for cooperating with the vial and (2) the interengageable means of said device, pressure containing means within the hollow interior of said control structure between said open ends dividing the hollow interior into a vented chamber communicating with said septum through said first open end and a sealed chamber communicating with the central exterior of the elastomeric stopper assembly of said vial through said second open end, said control structure having vent opening means therein communicating said vented chamber to the atmosphere, filter means disposed in cooperating relation with said vent opening means for enabling the pressure within said vented chamber to remain at atmospheric conditions while preventing movement of hazardous material outwardly through said vent opening means, means mounting said pressure containing means for movement in response to the increase of pressure conditions within said sealed chamber while said vented chamber is retained under atmospheric pressure conditions by said vent opening means from an initial position wherein the volume of said vented chamber is maximum and the volume of said sealed chamber is minimum to a final position wherein the volume of said vented chamber is minimum and the volume of said sealed chamber is maximum, said pressure containing means having a central portion capable of having the syringe needle which is first moved in penetrating relation through said septum thereafter moved in penetrating relation therethrough and of providing a seal after the syringe needle has been withdrawn so that when the syringe needle after having been moved in penetrating relation successively through said septum and said pressure containing means is thereafter moved in penetrating relation through the elastomeric stopper assembly any elevated pressure conditions and aerosoling of hazardous material which passes outwardly of the elastomeric stopper assembly incident to syringe needle withdrawal therefrom is captured within said sealed chamber and any elevated pressure conditions produced thereby are reduced substantially to atmospheric conditions by the increase of the volume of said sealed chamber through movement of said pressure containing means from said initial position until said pressure containing means reaches said final position so that the subsequent withdrawal of said syringe needle from said pressure containing means occurs while said sealed chamber is under atmospheric pressure conditions and hence no aerosoling of hazardous material into the vented chamber occurs incident to such withdrawal thereby enabling the subsequent withdrawal of the syringe needle from said septum to occur under uncontaminated atmospheric pressure conditions within said vented chamber.

11. A package as defined in claim 1 wherein said control structure includes a hollow control structure having opposite first and second open ends, the first open end of said control structure being closed by a septum capable of having the syringe needle moved in penetrating relation therethrough and of providing a seal after the syringe needle has been withdrawn, said control structure having a skirt portion for engaging over the open end and stopper assembly of the vial, said skirt portion having thereon (1) the means of the device for cooperating with the vial and (2) the interengageable means of said device, pressure containing means within the hollow interior of said control structure between said open ends dividing the hollow interior into a vented chamber communicating with said septum through said first open end and a sealed chamber communicating with the central exterior of the elastomeric stopper assembly of said vial through said second open end, said control structure having vent opening means therein communicating said vented chamber to the atmosphere, filter means disposed in cooperating relation with said vent opening means for enabling the pressure within said vented chamber to remain at atmospheric conditions while preventing movement of hazardous material outwardly through said vent opening means, means mounting said pressure containing means for movement in response to the increase of pressure conditions within said sealed chamber while said vented chamber is retained under atmospheric pressure conditions by said vent opening means from an initial position wherein the volume of said vented chamber is maximum and the volume of said sealed chamber is minimum to a final position wherein the volume of said vented chamber is minimum and the volume of said sealed chamber is maximum, said pressure containing means having a central portion capable of having the syringe needle which is first moved in penetrating relation through said septum thereafter moved in penetrating relation therethrough and of providing a seal after the syringe needle has been withdrawn so that when the syringe needle after having been moved in penetrating relation successively through said septum and said pressure containing means is thereafter moved in penetrating relation through the elastomeric stopper assembly any elevated pressure conditions and aerosoling of hazardous material which passes outwardly of the elastomeric stopper assembly incident to syringe needle withdrawal therefrom is captured within said sealed chamber and any elevated pressure conditions produced thereby are reduced substantially to atmospheric conditions by the increase of the volume of said sealed chamber through movement of said pressure containing means from said initial position until said pressure containing means reaches said final position so that the subsequent withdrawal of said syringe needle from said pressure containing means occurs while said sealed chamber is under atmospheric pressure conditions and hence no aerosoling of hazardous material into the vented chamber occurs incident to such withdrawal thereby enabling the subsequent withdrawal of the syringe needle from said septum to occur under uncontaminated atmospheric pressure conditions within said vented chamber.

12. A package as defined in claim 1 wherein said device is disposed within said sealed interior chamber in a position suitable to enable the vial to be moved into cooperating relation with the means of the device for cooperating with the vial when said package lid structure is moved into opening relation to said package container structure so as to retain said device in cooperating relation with the vial to thereby enable the device to be moved out of the open end of said interior chamber and said interengageable means to be moved into operative interengagement while said device is retained in cooperating relation with the vial.

13. A package as defined in claim 12 wherein said package container structure is a thin walled structure formed of a clear thermoplastic material suitable for radiation beam sterilization.

14. A package as defined in claim 13 wherein said package container structure includes a circular bottom wall and an annular peripheral wall extending from the periphery of the circular bottom wall and terminating in an outwardly extending annular flange defining the open end of said package container structure.

15. A package as in claim 14 wherein said bottom wall is of concavo-convex configuration and extends inwardly with respect to said interior chamber in a position to resiliently engage a bottom of the medicament vial when said interengaging means are interengaged.

16. A package as defined in claim 15 wherein said interengageable means includes an annular shoulder formed in said annular peripheral wall in a position spaced from and facing toward said annular flange and an annular flange on said device for engaging said shoulder to support said device within said interior chamber.

17. A package as defined in claim 16 wherein said interengageable means further includes a generally cylindrical surface on the interior of said peripheral wall extending inwardly from said annular shoulder and a series of annular rings of saw tooth shaped cross-sectional configuration on said device, said series of rings having sharp edges for digging into said cylindrical surface in response to a relative rectilinear movement between said device and said package container structure.

18. A package as defined in claim 12 wherein said package lid structure comprises a sheet of material adhered to said open end of said package container structure, said sheet material being of the semi-permeable membrane type suitable to enable said device to be sterilized while sealed in said interior chamber.

19. A package as defined in claim 18 wherein said sheet material is heat sealed with said open end of said package container structure.

* * * * *